US011638097B1

(12) United States Patent
Jin et al.

(10) Patent No.: US 11,638,097 B1
(45) Date of Patent: Apr. 25, 2023

(54) SPEAKER

(71) Applicant: AAC Microtech (Changzhou) Co., Ltd., Changzhou (CN)

(72) Inventors: Xin Jin, Shenzhen (CN); Fan Zhang, Shenzhen (CN); Wei Song, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/563,029

(22) Filed: Dec. 27, 2021

(30) Foreign Application Priority Data

Dec. 3, 2021 (CN) ..... 202123031758.6

(51) Int. Cl.
*H04R 9/02* (2006.01)
*H04R 7/20* (2006.01)

(52) U.S. Cl.
CPC ..... *H04R 9/025* (2013.01); *H04R 7/20* (2013.01)

(58) Field of Classification Search
CPC ..... H04R 9/025; H04R 7/20; H04R 1/2834; H04R 1/026; H04R 9/06; H04R 2499/11; H04R 1/1016; H04R 1/288; H04R 1/08; H04R 1/222; H04R 7/04; H04R 1/021; H04R 2307/025; H04R 1/2811; H04R 7/02; H04R 1/02; H04R 2209/027; H04R 1/023; H04M 1/026; H04M 1/035
See application file for complete search history.

(56) References Cited

U.S. PATENT DOCUMENTS

| | | | | |
|---|---|---|---|---|
| 11,356,767 | B2 * | 6/2022 | Cho | H04R 1/2834 |
| 2016/0241938 | A1 * | 8/2016 | Huang | H04R 1/023 |
| 2017/0366888 | A1 * | 12/2017 | Xiao | H04R 9/06 |
| 2017/0366900 | A1 * | 12/2017 | Linghu | H04R 31/003 |
| 2018/0227667 | A1 * | 8/2018 | Kim | H04R 1/42 |
| 2020/0413171 | A1 * | 12/2020 | Shen | H04R 9/025 |

FOREIGN PATENT DOCUMENTS

| | | | | |
|---|---|---|---|---|
| CN | 104469633 A | * | 3/2015 | H04R 9/06 |
| KR | 102167436 B1 | * | 10/2020 | H04R 1/06 |
| KR | 102442959 B1 | * | 9/2022 | H04R 7/04 |

* cited by examiner

*Primary Examiner* — Angelica M McKinney
(74) *Attorney, Agent, or Firm* — W&G Law Group

(57) ABSTRACT

The present disclosure discloses a speaker including a frame with two open ends, a vibration system sealing one open end of the frame, a magnetic circuit system, and an air-permeable mesh. The magnetic circuit system includes a yoke sealing another open end of the frame, a first magnet, a second magnet arranged at two opposite sides of the first magnet, a through hole penetrating the yoke and arranged at another two opposite sides of the first magnet, and an extension wall bending and extending from a side of the through hole close to the first magnet in a direction close to the vibration system. The air-permeable mesh is attached to the yoke and covers the through hole. Compared with the related art, the speaker disclosed by the present disclosure has a better acoustic performance.

6 Claims, 4 Drawing Sheets

SPEAKER

FIELD OF THE PRESENT DISCLOSURE

The present disclosure relates to electroacoustic transducers, in particular to a speaker.

DESCRIPTION OF RELATED ART

A speaker in the related art includes a frame, a vibration system and a magnetic circuit system fixed to the frame. The vibration system includes an upper diaphragm, an elastic supporting member locating at a side of the upper diaphragm close to the magnetic circuit system and spaced apart from the upper diaphragm, a skeleton for connecting the upper diaphragm and the elastic supporting member, and a voice coil fixed to the skeleton. The magnetic circuit system includes a yoke, a first magnet mounted on the yoke, and a second magnet mounted on the yoke and arranged at two opposite sides of the first magnet. The elastic supporting member is arranged at another two opposite sides of the first magnet, thereby, the magnetic circuit system has to cancel the second magnet at the another two opposite sides of the first magnet since the elastic supporting member occupies the space. Thus, a serious magnetic leakage happens at the another two opposite sides of the first magnet, which is bad to acoustic performances of the speaker.

In addition, the speaker is usually installed in a shell and combines with the shell for forming a speaker box. An acoustic back cavity enclosed by the speaker and the shell is filled with sound-absorbing powders for improving low-frequency performances of the speaker box. In order to prevent the sound-absorbing powders from entering the inside of the speaker, a part of the acoustic back cavity is separated by an air-permeable mesh for filling the sound-absorbing powders, which makes it impossible to utilize the entire volume of the acoustic back cavity for filling the sound-absorbing powders and restricts low-frequency performances of the speaker box.

Thus, it is necessary to provide a novel speaker to solve the problem.

SUMMARY

An objective of the present disclosure is to provide a speaker which has a better acoustic performance.

In order to achieve the objective mentioned above, the present disclosure discloses a speaker including a frame with two open ends, a vibration system fixed to the frame and sealing one open end of the frame, a magnetic circuit system fixed to the frame, and an air-permeable mesh. The magnetic circuit system includes a yoke fixed to the frame and sealing another open end of the frame, a first magnet mounted on the yoke, a second magnet mounted on the yoke and arranged at two opposite sides of the first magnet, a through hole penetrating the yoke and arranged at another two opposite sides of the first magnet, and an extension wall bending and extending from a side of the through hole close to the first magnet in a direction close to the vibration system. The second magnet and the extension wall are respectively spaced apart from the first magnet. The air-permeable mesh is attached to the yoke and covers the through hole. Compared with the related art, the second magnet is arranged at two opposite sides of the first magnet, the through hole penetrates the yoke and is arranged at another two opposite sides of the first magnet, the extension wall bends and extends from the side of the through hole close to the first magnet in a direction close to the vibration system and is spaced apart from the first magnet. The extension wall increases the magnetic permeability and reduces the magnetic leakage at the another two opposite sides of the first magnet for improving magnetic performances of the magnetic circuit system and further acoustic performances of the speaker. Moreover, when the speaker is installed in a shell and combines with the shell for forming a speaker box, because the yoke seals the another open end of the frame and the air-permeable mesh attached to the yoke covers the through hole for prevent sound-absorbing powders from entering the inside of the speaker, the entire volume of the acoustic back cavity enclosed by the speaker and the shell can be used for filling the sound-absorbing powders for improving low-frequency performances of the speaker box.

Further, the yoke includes an inner surface close to the vibration system, an outer surface opposite to the inner surface, and a groove recessed from the outer surface toward the inner surface. The through hole locates in the groove. The air-permeable mesh accommodates in the groove and covers the through hole.

Further, the vibration system includes an upper diaphragm, an elastic supporting member locating at a side of the upper diaphragm close to the magnetic circuit system and spaced apart from the upper diaphragm, a skeleton for connecting the upper diaphragm and the elastic supporting member, and a voice coil fixed to the skeleton. The elastic supporting member is arranged directly opposite to the through hole and between the extension wall and the frame.

Further, the skeleton includes a main body part, and an extension part bending and extending from the main body part in a direction close to the elastic supporting member. The extension part is fixed to the elastic supporting member and arranged between the extension wall and the frame. The upper diaphragm includes a suspension, an inner fixing part extending from an inner periphery of the suspension and fixed to the skeleton, and an outer fixing part extending from an outer periphery of the suspension and fixed to the frame. The main body part together with the upper diaphragm seals the one open end of the frame.

Further, the voice coil locates in a gap formed between the extension wall and the first magnet.

Further, the elastic supporting member includes a flexible circuit board fixed to the extension part, and a lower diaphragm fixed to the flexible circuit board. The flexible circuit board includes a first surface close to the upper diaphragm and a second surface opposite to the first surface. The lower diaphragm is fixed to the second surface. The extension part is fixed to the first surface.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure.

DETAILED DESCRIPTION OF THE EMBODIMENTS

The present disclosure will hereinafter be described in detail with reference to the embodiments. To make the technical problems to be solved, and technical solutions and beneficial effects of the present disclosure more apparent, the present disclosure is described in further detail together with the figures and the embodiments. It should be understood the embodiments described hereby are only to explain the disclosure, not intended to limit the disclosure.

Figure 1:
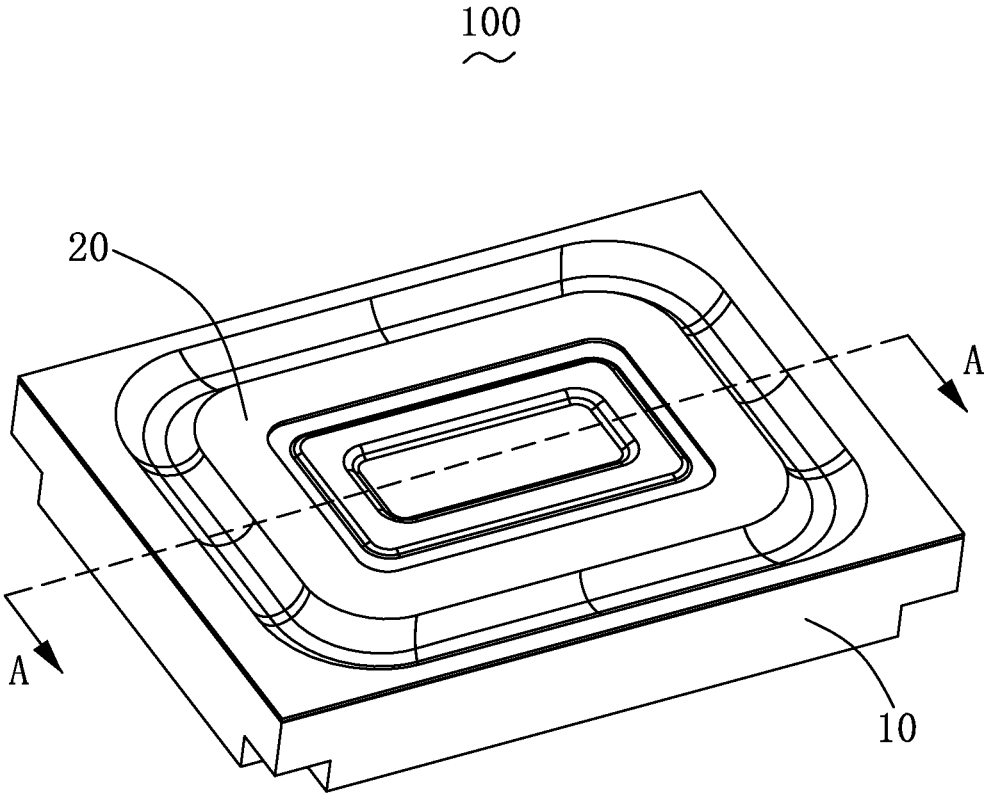
FIG. 1 is an isometric view of a speaker in accordance with an exemplary embodiment of the present disclosure.
Figure 2:
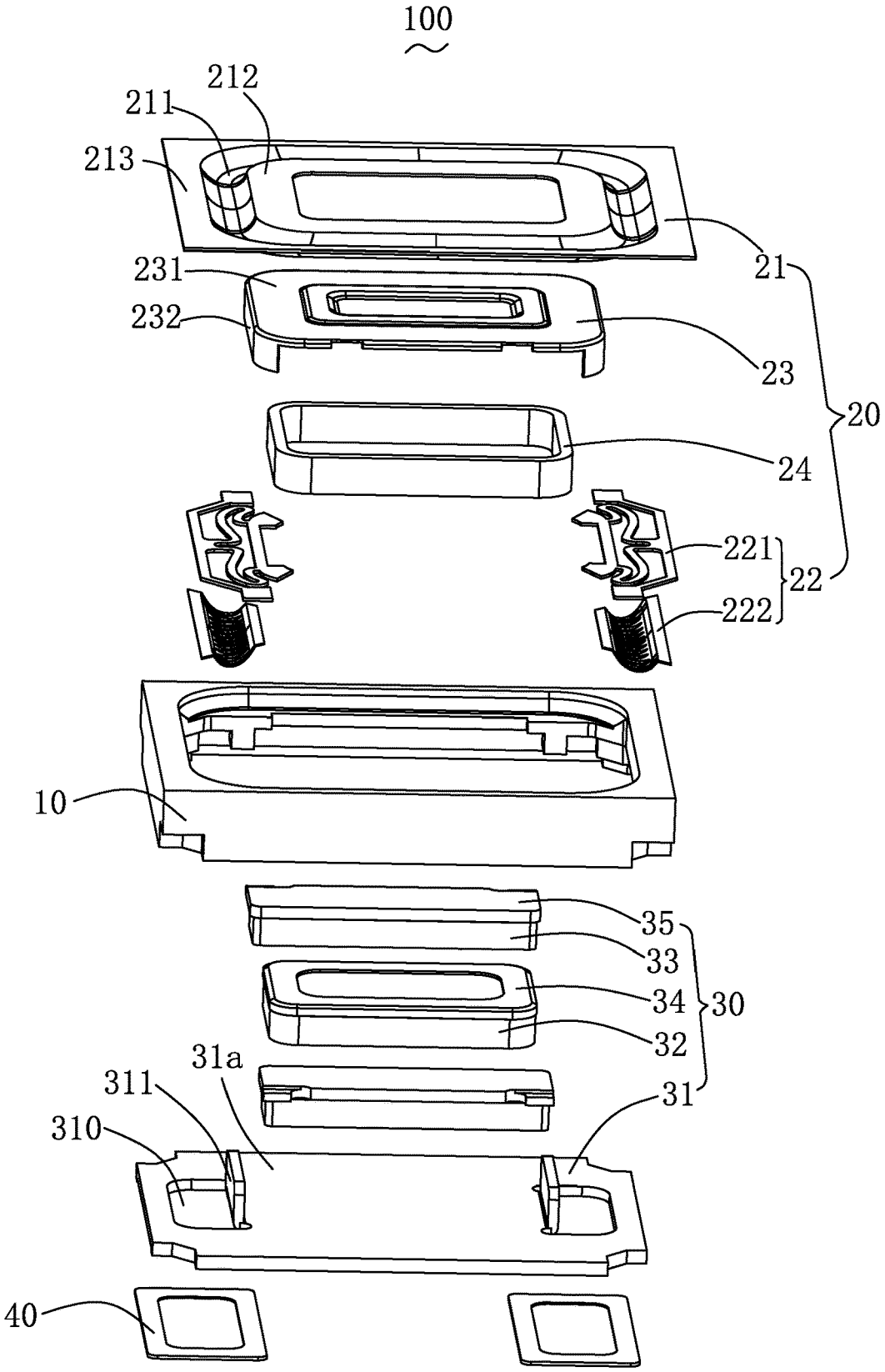
FIG. 2 is an exploded view of the speaker in FIG. 1.
Figure 3:
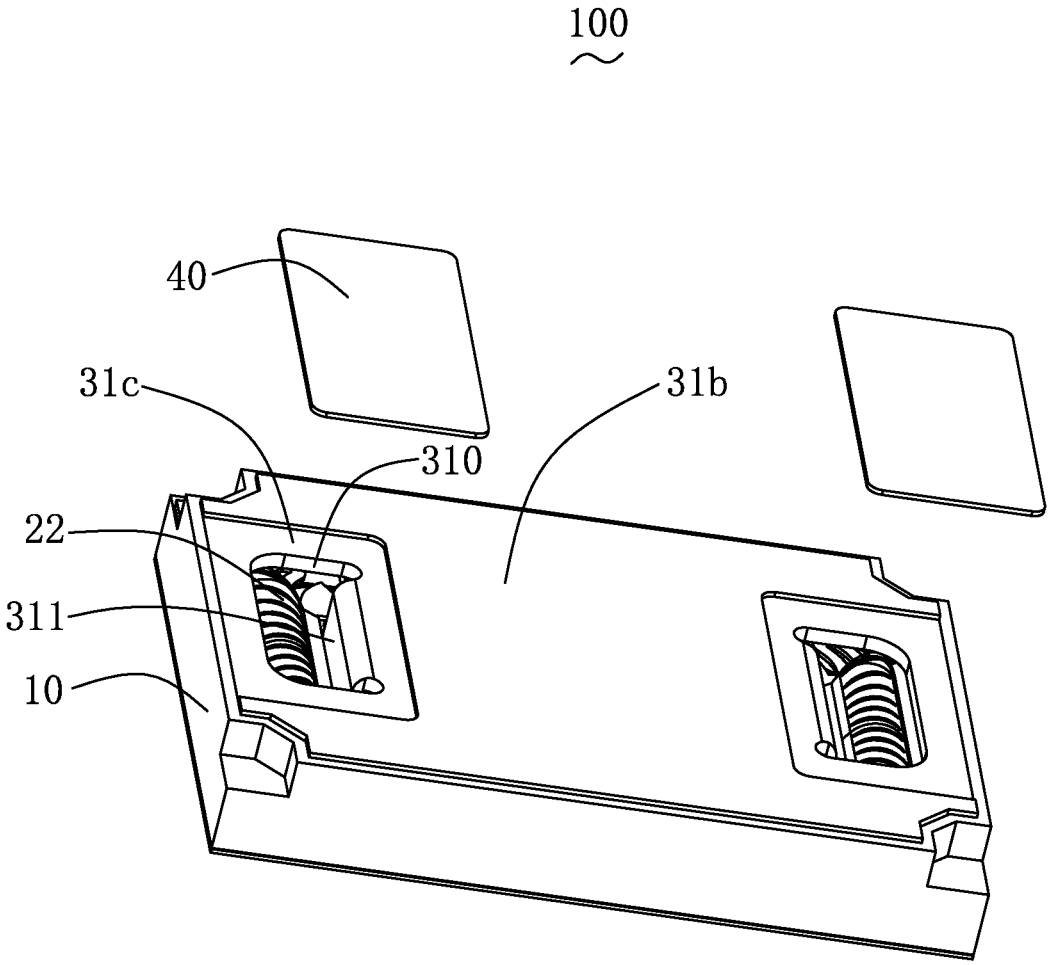
FIG. 3 is an partially exploded view of the speaker in FIG. 1
Figure 4:
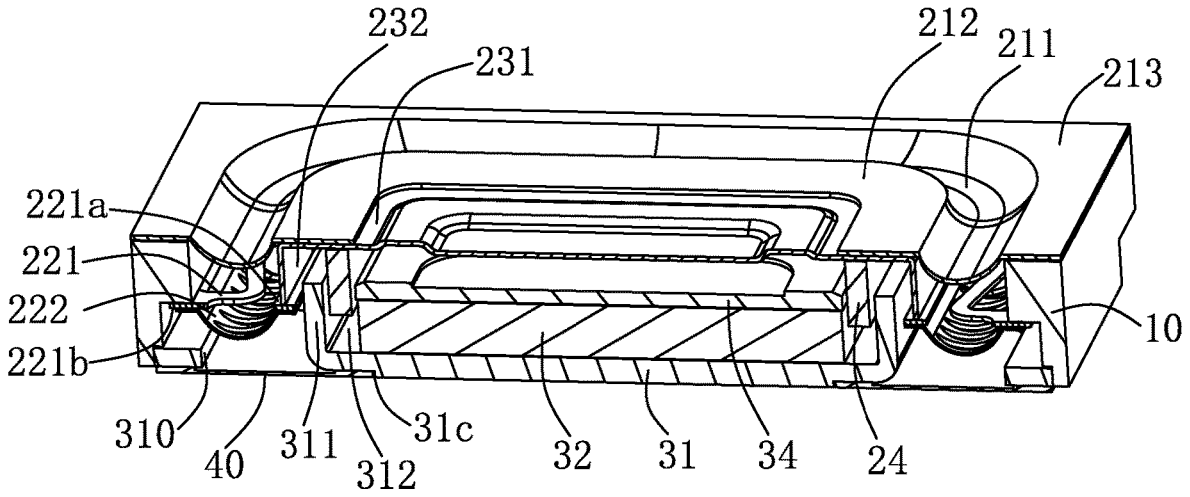
FIG. 4 is a cross-sectional view of the speaker taken along line A-A in FIG. 1.

Referring to FIGS. 1-4, the present disclosure discloses a speaker 100 including a frame 10 with two open ends, a vibration system 20 fixed to the frame 10, and a magnetic circuit system 30 fixed to the frame 10 for driving the vibration system 20 to vibrate and emit sound.

The vibration system 20 seals one open end of the frame 10, which includes an upper diaphragm 21, an elastic supporting member 22 locating at a side of the upper diaphragm 21 close to the magnetic circuit system 30 and spaced apart from the upper diaphragm 21, a skeleton 23 for connecting the upper diaphragm 21 and the elastic supporting member 22, and a voice coil 24 fixed to the skeleton 23.

The magnetic circuit system 30 includes a yoke 31 fixed to the frame 10 and sealing another open end of the frame 10, a first magnet 32 mounted on the yoke 31, a second magnet 33 mounted on the yoke 31 and arranged at two opposite sides of the first magnet 32, a first pole plate 34 attached on the first magnet 32, a second pole plate 35 attached on the second magnet 33, a through hole 310 penetrating the yoke 31 and arranged at another two opposite sides of the first magnet 32, and an extension wall 311 bending and extending from a side of the through hole 310 close to the first magnet 32 in a direction close to the vibration system 20. The second magnet 33 and the extension wall 311 are respectively spaced apart from the first magnet for forming a magnetic gap 312 for receiving the voice coil 24.

An air-permeable mesh 40 is attached to the yoke 31 and covers the through hole 310. Optionally, the yoke 31 includes an inner surface 31*a* close to the vibration system 20, an outer surface 31*b* opposite to the inner surface 31*a*, and a groove 31*c* recessed from the outer surface 31*b* toward the inner surface 31*a*. The through hole 310 locates in the groove 31*c*. The air-permeable mesh 40 accommodates in the groove 31*c* and covers the through hole 310.

Optionally, the elastic supporting member 22 is arranged directly opposite to the through hole 310 and between the extension wall 311 and the frame 10, thereby, the through hole 310 offers an extra vibration space for the elastic supporting member 22.

Optionally, the skeleton 23 includes a main body part 231, and an extension part 232 bending and extending from the main body part 231 in a direction close to the elastic supporting member 22. The extension part 232 is arranged between the extension wall 311 and the frame 10. The elastic supporting member 22 is fixed between the extension part 232 and the frame 10.

Optionally, the upper diaphragm 21 includes a suspension 211, an inner fixing part 212 extending from an inner periphery of the suspension 211 and fixed to the skeleton 23, and an outer fixing part 213 extending from an outer periphery of the suspension 211 and fixed to the frame 10. The main body part 231 together with the upper diaphragm 21 seals the one open end of the frame 10, in this way, the main body part 231 can serve as a dome so as to cancel a separate dome.

Optionally, the elastic supporting member 22 includes a flexible circuit board 221 fixed to the extension part 232, and a lower diaphragm 222 fixed to the flexible circuit board 221. The flexible circuit board 221 includes a first surface 221*a* close to the upper diaphragm 21, and a second surface 221*b* opposite to the first surface 221*a*. The lower diaphragm 222 is fixed to the second surface 221*b*. The extension part 232 is fixed to the first surface 221*a*. The voice coil 24 can be electrically connected with an external circuit via the flexible circuit board 221.

Compared with the related art, the second magnet 33 is arranged at two opposite sides of the first magnet 32, the through hole 310 penetrates the yoke 31 and is arranged at another two opposite sides of the first magnet 32, the extension wall 311 bends and extends from the side of the through hole 310 close to the first magnet 32 in a direction close to the vibration system 20 and is spaced apart from the first magnet 32. The extension wall 311 increases the magnetic permeability and reduces the magnetic leakage at the another two opposite sides of the first magnet 32 for improving magnetic performances of the magnetic circuit system 30 and further acoustic performances of the speaker 100. Moreover, when the speaker 100 is installed in a shell and combines with the shell for forming a speaker box, because the yoke 31 seals the another open end of the frame 10 and the air-permeable mesh 40 attached to the yoke 31 covers the through hole 310 for prevent sound-absorbing powders from entering the inside of the speaker 100, the entire volume of the acoustic back cavity enclosed by the speaker 100 and the shell can be used for filling the sound-absorbing powders for improving low-frequency performances of the speaker box.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms where the appended claims are expressed.

What is claimed is:

1. A speaker, comprising:

a frame with two open ends;

a vibration system fixed to the frame, sealing one open end of the frame;

a magnetic circuit system fixed to the frame, comprising:

a yoke fixed to the frame, sealing another open end of the frame;

a first magnet mounted on the yoke;

a second magnet mounted on the yoke, arranged at two opposite sides of the first magnet and spaced apart from the first magnet;

a through hole penetrating the yoke, arranged at another two opposite sides of the first magnet;

an extension wall bending and extending from a side of the through hole close to the first magnet in a direction close to the vibration system, spaced apart from the first magnet; and an air-permeable mesh, attached to the yoke and covering the through hole.

2. The speaker as described in claim 1, wherein the yoke comprises an inner surface close to the vibration system, an outer surface opposite to the inner surface, and a groove recessed from the outer surface toward the inner surface, the through hole locates in the groove, the air-permeable mesh accommodates in the groove and covers the through hole.

3. The speaker as described in claim 1, wherein the vibration system comprises an upper diaphragm, an elastic supporting member locating at a side of the upper diaphragm close to the magnetic circuit system and spaced apart from the upper diaphragm, a skeleton for connecting the upper diaphragm and the elastic supporting member, and a voice coil fixed to the skeleton, the elastic supporting member is arranged directly opposite to the through hole and between the extension wall and the frame.

4. The speaker as described in claim 3, wherein the skeleton comprises a main body part, and an extension part bending and extending from the main body part in a direction close to the elastic supporting member, the extension part is fixed to the elastic supporting member and arranged between the extension wall and the frame, the upper diaphragm comprises a suspension, an inner fixing part extending from an inner periphery of the suspension and fixed to the skeleton, and an outer fixing part extending from an outer periphery of the suspension and fixed to the frame, the main body part together with the upper diaphragm seals the one open end of the frame.

5. The speaker as described in claim 3, wherein the voice coil locates in a gap formed between the extension wall and the first magnet.

6. The speaker as described in claim 3, wherein the elastic supporting member comprises a flexible circuit board fixed to the extension part, and a lower diaphragm fixed to the flexible circuit board, the flexible circuit board comprises a first surface close to the upper diaphragm and a second surface opposite to the first surface, the lower diaphragm is fixed to the second surface, the extension part is fixed to the first surface.

* * * * *